US005868330A

United States Patent [19]

Dodd et al.

[11] Patent Number: 5,868,330

[45] Date of Patent: Feb. 9, 1999

[54] REFINER DISC WITH LOCALIZED SURFACE ROUGHNESS

[75] Inventors: John Dodd, Arvada, Colo.; Paul Wasikowski, Cudahy, Wis.

[73] Assignee: J & L Fiber Services, Inc., Waukesha, Wis.

[21] Appl. No.: 902,729

[22] Filed: Jul. 30, 1997

Related U.S. Application Data

[62] Division of Ser. No. 534,522, Sep. 27, 1995, Pat. No. 5,690,286.

[51] Int. Cl.[6] ..... B02C 7/12

[52] U.S. Cl. ..... 241/296; 241/300

[58] Field of Search ..... 241/261.2, 261.3, 241/296, 297, 298, 300, 197

[56] References Cited

U.S. PATENT DOCUMENTS

| | | |
|---|---|---|
| 3,462,089 | 8/1969 | Whitlow . |
| 4,061,283 | 12/1977 | Kahman . |
| 4,871,119 | 10/1989 | Murata et al. . |
| 4,951,888 | 8/1990 | Sharpe et al. . |
| 5,165,592 | 11/1992 | Wasikowski . |
| 5,192,597 | 3/1993 | Forsythe . |
| 5,201,917 | 4/1993 | Brunet et al. . |
| 5,492,548 | 2/1996 | Wasikowski . |
| 5,580,472 | 12/1996 | Maybon . |
| 5,690,286 | 11/1997 | Dodd et al. . |

FOREIGN PATENT DOCUMENTS

| | | |
|---|---|---|
| 0480851 | 4/1992 | European Pat. Off. . |

*Primary Examiner*—Mark Rosenbaum
*Attorney, Agent, or Firm*—Nilles & Nilles, S.C.

[57] ABSTRACT

A refiner plate has bars integrally formed with the refiner plate base member which have discrete regions of selected physical properties. A material possessing the physical property is deposited in a reservoir in the bar, such as a groove. The reservoir may be positioned in the top of the bar and may be of various shapes. Alternatively, the reservoir with material is positioned on the bar leading or trailing edge. Alternatively, an abrasive surface extends over the entire upper surface of the bar including the leading and trailing edges. The bar may be formed of a white iron alloy which is heat-treated to form a soft matrix with embedded carbide grains. By protecting regions of desired smoothness with a wear-resistant protective coating flow is preserved in selected areas.

19 Claims, 4 Drawing Sheets

REFINER DISC WITH LOCALIZED SURFACE ROUGHNESS

This is a divisional of application Ser. No. 08/534,522 filed on Sep. 27, 1995, now U.S. Pat. No. 5,690,286.

FIELD OF THE INVENTION

This invention relates to refiners in general and to rotary refiners in particular.

BACKGROUND OF THE INVENTION

Disc refiners are utilized in papermaking to prepare wood fibers to be made into paper on a papermaking machine. Disc refiners are generally divided into two types: those for refining high consistency stocks containing 18 to 60 percent fiber by weight; and those for refining low consistency stocks having two to five percent fiber by weight. High consistency refiners produce mechanical and semi-mechanical pulp or furnish from undigested wood chips and semi-digested wood chips. These refiners break down the wood chips and clumps of wood fibers into individual fibers from which paper is formed.

Processing of fibers in a low consistency refiner may be performed on both chemically and mechanically refined pulps, and in particular may be used sequentially with a high consistency refiner to further process the fibers after they have been separated in the high consistency disk refiner. In operation, a low consistency disc refiner is generally considered to exert a type of abrasive action upon individual fibers in the pulp mass so that the outermost layers of the individual cigar-shaped fibers are frayed. This fraying of the fibers, which is considered to increase the freeness of the fibers, facilitates the bonding of the fibers when they are made into paper.

Paper fibers are relatively slender, tube-like structural components made up of a number of concentric layers. Each of these layers (called "lamellae") consists of finer structural components (called "fibrils") which are helically wound and bound to one another to form the cylindrical lamellae. The lamellae are in turn bound to each other, thus forming a composite which has distinct bending and torsional rigidity characteristics. A relatively hard outer sheath (called the "primary wall") encases the lamellae. The primary wall is often partially removed during the pulping process. The raw fibers are relatively stiff and have relatively low surface area when the primary wall is intact, and thus exhibit poor bond formation and limited strength in the paper formed with raw fibers.

It is generally accepted that it is the purpose of a pulp stock refiner to partially remove the primary wall and break the bonds between the fibrils of the outer layers to yield a frayed surface, thereby increasing the surface area of the fiber multi-fold.

Disc refiners typically consist of a pattern of raised bars interspaced with grooves. Paper fibers contained in a water stock are caused to flow between opposed refiner discs which are rotating with respect to each other. As the stock flows radially outwardly across the refiner plates, the fibers are forced to flow over the bars. The fiber treating action is thought to take place there, between the closely spaced bars on opposed discs. It is known that sharp bar edges promote fiber stapling and fibrillation due to fiber-to-fiber action. To achieve this, an advantageous method of fabricating bars which wear sharp has been utilized in the construction of refiner plates such as disclosed in U.S. Pat. No. 5,165,592 to Wasikowski. It is also known that dull bar edges result in fiber cutting by fiber-to-bar action. Fiber cutting is undesirable because it results in paper of weaker strength and renders a certain portion of the fibers too small to be retained on the screen on which the paper is formed, thus increasing waste.

The preferred action in refining paper fibers is fibrillation. Fibrillation is the breaking down of the primary wall and partially releasing the fibrils of the outer layer to yield the frayed surface, which increases the surface area of the fiber multi-fold. Improved fibrillation with minimal fiber damage has been theorized as possible if a refiner bar having a rough or abrasion resistant edge is used. The rough or abrasion resistant edge, which resists dulling during operation, holds the fibers longer while the sharpness of the rough surface acts to gently abrade the fibers. A rough or abrasion resistant edge is difficult to obtain without affecting all of the surrounding surfaces. If all of the surrounding surfaces are treated, fiber flow through the refiner may be impaired by the loss of open area in the grooves between the refiner bars as well as by the added friction of the abrasive material. Treatment of the entire groove and treatment of the bar surface have been accomplished by surface modification techniques but the edge has not been isolated.

Both theory and logic suggests that work is being done to wood fibers passing through a refiner principally as the fibers pass over the outermost surface of the bars. Thus, it is desirable to retain the fibers on the outermost surface and to build up a fiber pad thereon to promote refining. One way to retain fibers on the outermost surface of refiner bars is to make the surface rough. The roughness creates numerous edges to hold the fibers so that they may be refined.

There are many ways of depositing a rough surface or other coating on a refining plate bar, but these have all involved adding thin layers of material on top of the bars after they have been finished because the bar surfaces must be ground to obtain flatness and bar depth requirements. Thus, the problem associated with depositing a rough surface or other coating on the outermost surface of the refiner bars is that, on the one hand, it can affect the flatness of the bars, which interferes with the ability to run opposed discs closely spaced; and on the other hand, there is a tendency of the relatively thinly deposited layer to rapidly wear away during operation in a refiner.

What are needed are techniques for creating localized areas of surface roughness which resist wearing away.

SUMMARY OF THE INVENTION

The disk refiner of this invention employs refiner bars integrally formed with the refiner plate which have selected regions of high roughness, resistance to abrasion or other unique characteristics. In one of the embodiments of the invention, an abrasive or other material is deposited or formed in U-shaped, V-shaped, or trapezoidal grooves which are formed down the center of the uppermost surface of the refiner bars. Roughness centrally located in the bars serves to retain wood fibers on the uppermost surface of the bar where the refining action is thought to take place. In this way the fibers are retained for an extended period of time in the location where the most refining action is taking place, thus increasing the fibrillation of the fibers which increases the strength of the papers made from the fibers.

Another embodiment places abrasive or other materials on one or both sides of the blade so that the leading edge or trailing edge of the refiner bar is constructed of abrasive materials. Yet another way of achieving an abrasive surface over the entire upper surface of the bar including the leading and trailing edges is to form the bar of a white iron alloy which may be heat treated to form a soft matrix with embedded carbide grains. The carbide grains may be exposed to form a rough surface either by normal wear of the refiner disc in use or by etching the bar surface with an acid such as concentrated sulfuric or hydrochloric acid. Selective regions of roughness are developed by protecting those portions of the refiner plate and bar on which roughness is not desired, mainly the grooves which are formed by the sides of the bars, with a protective material that prevents erosion or etching such as a paint polymer or an etch- and wear-resistant metal. Thus, a refiner disc is formed of a white iron alloy and the entire refining surface together with the bars are coated with an etch-and wear-resistant surface. Subsequent to coating, the normal procedure for forming the uppermost surface of the bars, that of grinding the bars parallel to the plate, is performed. The grinding operation selectively removes the wear- and etch-resistant coating from the top or the uppermost surface of the bars. The bars may then be etched with acid or allowed to wear naturally to form a rough surface on the entire upper surface of the bars.

It is a feature of the present invention to provide a refiner disc with refiner bars which have unique characteristics in selected locations.

It is another feature of the present invention to provide refiner discs having refiner bars wherein the edges of the bars are rough.

It is a further feature of the present invention to provide refiner bars wherein the central portion of the bar is rough to retain a fiber mat thereon.

Further objects, features, and advantages of the invention will be apparent from the following detailed description when taken in conjunction with the accompanying drawings.

DESCRIPTION OF THE PREFERRED EMBODIMENT

Figure 1:
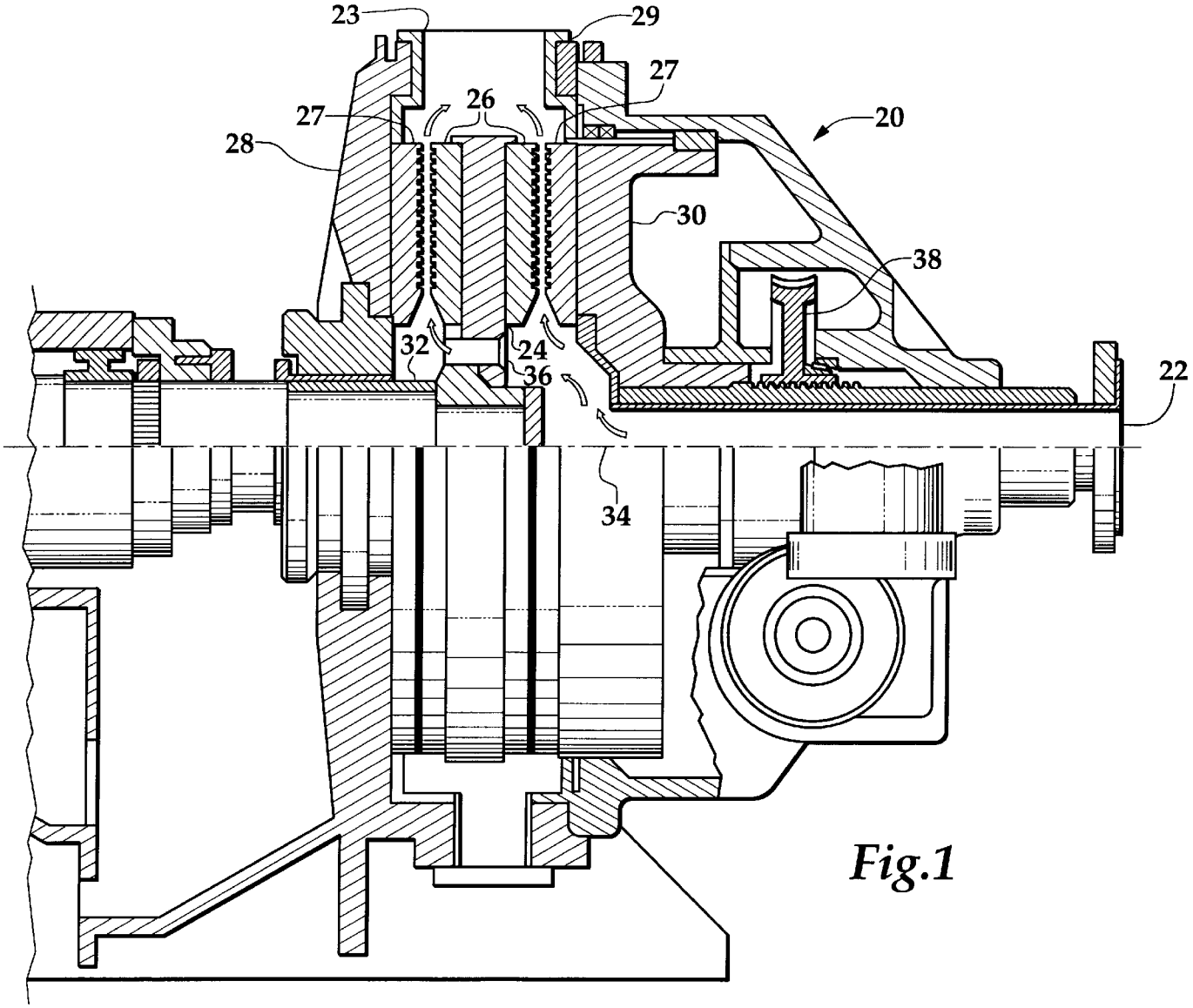
FIG. 1 is a side-elevational view, in particular cross-section, of a low consistency disc refiner.
Figure 2:
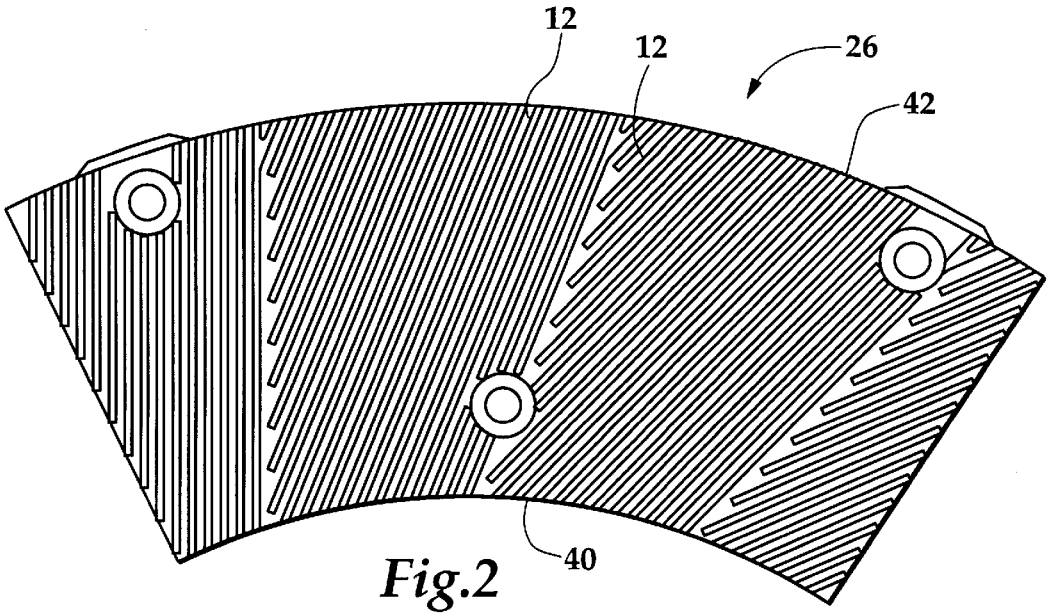
FIG. 2 is a segment of a disc refiner plate of this invention.

Referring more particularly to FIGS. 1–19 wherein like numbers refer to similar parts, a segment for a refiner plate 26 is shown in FIG. 2. Similar segments may be used for a refiner plate 27 operated in opposed, spaced relationship to the plate 26 when installed in a refiner 20. The refiner plates 26, 27 have bars 12 and the bars have selected regions 14 which are constructed of a rough or abrasive material 16. The refiner plates are used to refine fibers in the disc refiner 20.

In the description and claims of the present invention, reference to rough or abrasive material will be used for case of description. It should be recognized, however, that the present invention is useful for providing differential properties within a refiner bar, and may be used to provide localized, unique characteristics such as, but not limited to, wear resistance on a ductile bar, areas of differential corrosion or erosion resistance and the like in addition to roughness or abrasiveness.

A disc refiner 20, as shown in FIG. 1 has a housing 29 with a stock inlet 22 through which papermaking stock, normally consisting of two to five percent fiber dryweight dispersed in water, is pumped, typically at a pressure of 20 to 40 psi. Refiner plates 26 are mounted on a rotor 24. Refiner plates 27 are also mounted to a non-moving head 28 and to a sliding head 30. The refiner plates 27 which are mounted to the non-moving head 28 and the sliding head 30 are opposed and closely spaced from the refiner plates 26 on the rotor 24.

The rotor 24 is mounted to a shaft 32. The shaft 32 is mounted so that the rotor 24 may be moved axially along the axis 34 of the shaft. The rotor has passageways 36 which allow a portion of the stock to flow through the rotor 24 and pass between the refiner plates 26, 27 which are opposed between the rotor and the stationary head 28. A portion of the stock also passes between the refiner plates 26 mounted on the rotor and the refiner plates 27 mounted on the sliding head 30. After being refined by the rotor the stock leaves the housing 29 through an outlet 23.

In operation, the gaps between the refiner plates 26 mounted on the rotor 24, and the refiner plates 27 mounted on the non-rotating heads 28 and 30, are typically three to eight thousandths of an inch. The dimensions of the gaps between the refiner plates 26, 27 are controlled by positioning the rotor between the non-moving head 28 and the sliding head 30. Stock is then fed to the refiner 20 and passes between the rotating and non-rotating refiner plates 26, 27 establishing hydrodynamic forces between the rotating and non-rotating refiner plates. The rotor is then released so that it is free to move axially along the axis 34 by means of a slidable shaft 32. The rotor 24 seeks a hydrodynamic equilibrium between the non-rotating head 28 and the sliding head 30. The sliding head 30 is rendered adjustable by a gear mechanism 38 which slides the sliding head 30 towards the stationary head 28. The hydrodynamic forces of the stock moving between the stationary and the rotating refiner plates 26, 27 keeps the rotor centered between the stationary head 28 and the sliding head 30, thus ensuring a uniform, closely spaced gap between the stationary and rotating refiner plates 26, 27.

Figure 3:
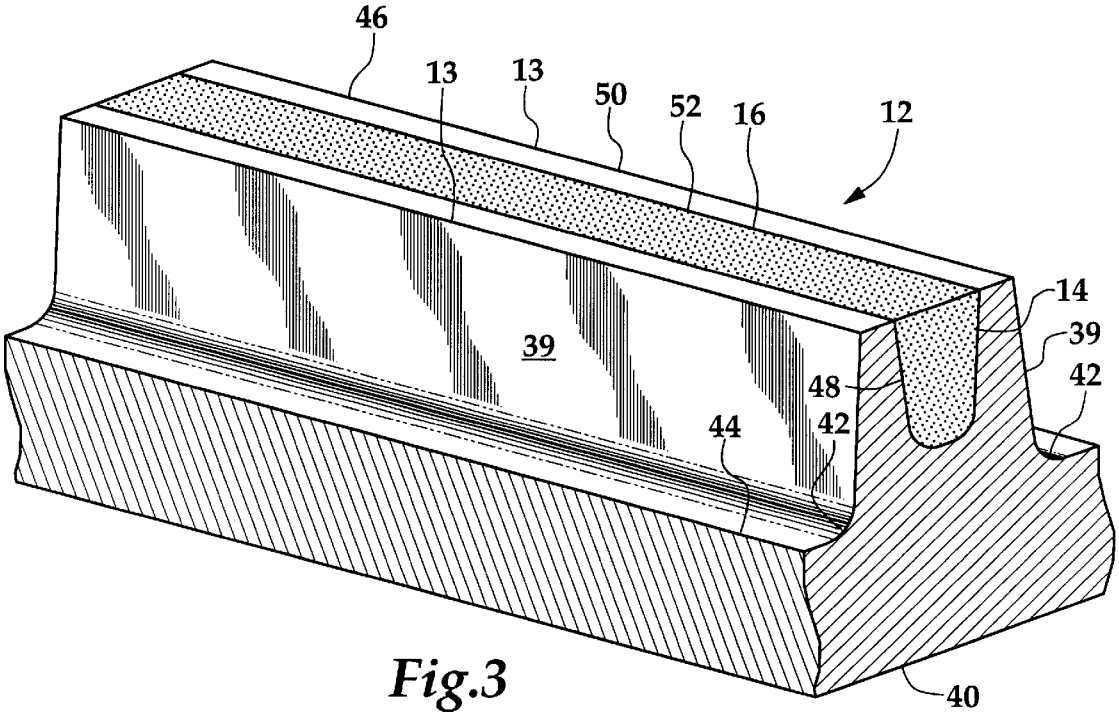
FIG. 3 is an isometric view, partially cut away in section, of a single bar of the disc refiner of FIG. 2.

As shown in FIG. 3, the bars 12 that perform the refining action on the plates 26, 27 have sides 39 which define the upstanding bars 12. The sides 39 extend upwardly of a base member 40 and are integrally formed with the base member 40. Flow passages 42 between the bars 12 are defined by the sides 39 and portions 44 of the base 40 which form the bottoms of the flow passages 42. Stock comprised of wood fibers suspended in water flows between the plates 26, 27 as shown in FIG. 1. The flowing stock principally travels in the flow passages 42. However, as the stock traverses the plates 26, 27, the bars 12, as shown for example in FIG. 2, are designed to cause the stock to pass over the bar tops 46. It is while the wood fibers pass over bar tops that they are engaged by the bars on the opposed disc, and thus refined.

In existing refiner plates, an abrasive material has been sprayed or coated on the upper surface of the bars. However, the discs and bars operating in a refiner are subject to extensive wear over their useful life and the surface coating of abrasive is rapidly worn away. In accordance with the present invention, the base member and bars of the refiner plate are integrally formed of a first material. The bars are shaped to define reservoirs, and a second material, chosen for a specific characteristic such abrasiveness, fills the reservoir. As shown in FIG. 3, in the refiner plates of this invention, the bars 12 have upwardly extending side members 13 which are spaced from one another to define deep reservoirs such as U-shaped grooves 48 which extend downwardly from the bar top upper surface 50 toward the refiner disc base member 40. The manufacture of the refiner plates 26, together with the bars 12, is preferably formed by sand casting. The rough or abrasive material 16 may be of any granular material with high hardness and wear resistance such as, but not limited to, alumina, silica, zirconia, silicon carbide, tungsten carbide, vanadium carbide, and niobium carbide. Materials having other desired properties also may be used. The material may be placed or formed within the groove 48 by a number of techniques.

One technique is set forth in U.S. Pat. No. 5,942,548 which is incorporated herein by reference. The process in the foregoing application involves placing the material in the sand mold used to form the refiner plate 26. In order that the material may become an integral part of the refiner bars 12, it may advantageously be coated with a flux material. The flux material causes the material 16 to be temporarily bonded together and at the same time facilitates the penetration of the granular material by the molten base metal from which the refiner plates 26, 27 are formed. Thus, in the finished product, an abrasive or other material 16 is embedded in a matrix of the material used to form the plates, the plates typically being formed of cast iron, preferably a white cast iron or stainless steel.

Figure 4:
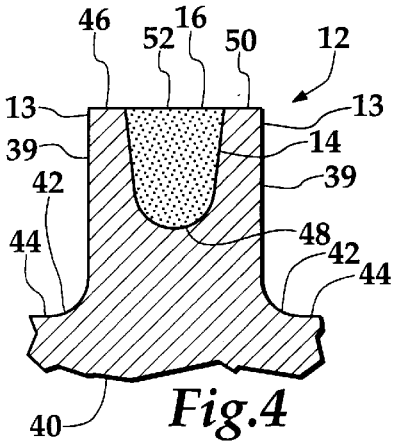
FIG. 4 is a cross-sectional view of the bar of the disc refiner of FIG. 2.

Thus the bars 12, as shown in FIGS. 3 and 4, have portions 52 of the bar top surfaces 50 which are rough and further remain rough as the upper surface 50 of the bar wears away.

This rough portion 52 of the upper surface retains wood fibers as they flow over the bar tops 46, thus increasing the time during which the wood fibers may be subject to the refining action of the opposed plates 26, 27 in a refiner as shown in FIG. 1.

The reservoirs filled with abrasive material may be of various groove configurations, as shown in the embodiments of FIGS. 5–9.

Figure 5:
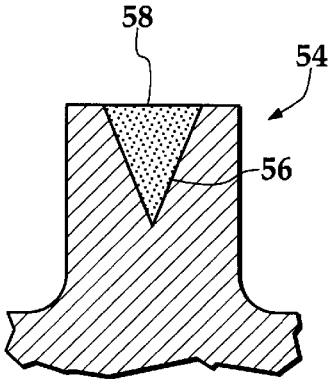
FIG. 5 is a cross-sectional view of an alternative disc refiner bar.

FIG. 5 shows an alternative embodiment refiner bar 54 with a V-shaped groove 56 filled with material 58.

Figure 6:
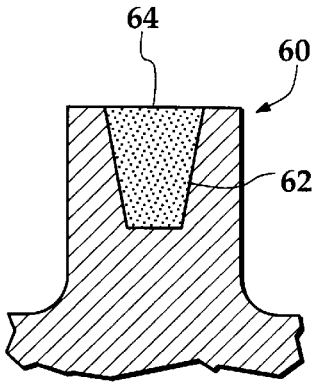
FIG. 6 is a cross-sectional view of another alternative disc refiner bar.

FIG. 6 shows a refiner bar 60 with a trapezoidal groove 62 filled with material 64.

The V-shaped groove 56 in the bar 54 and the trapezoidal shaped groove 62 in bar 60 are examples of other groove shapes which may be readily formed in a cast refiner plate.

Figure 12:
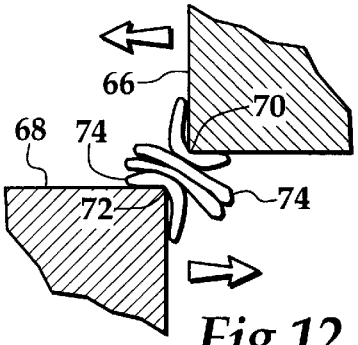
FIG. 12 is a schematic view showing the refining action of two sharp bars.

Fibrillation is the external disruption of the lateral bonds between surface layers of a fiber that results in partial detachment of fibers or small pieces of the outer layers of the fibers and internal or lateral bonds between the adjacent layers within the fibers. Fibrillation occurs during the mechanical refining of pulp slurries. In a disc refiner, a substantial portion of the fibrillation is thought to occur between the edges of opposed refiner plates. Paper fibers 74 undergoing refining are shown in FIG. 12. An upper bar 66 has a sharp edge 70, and a lower bar 68 has a sharp edge 72. The fibers 74 are held by the sharp edges 70, 72, and an abraiding or bruising action between the fibers takes place as the bar edges pass over each other as indicated by arrows.

Figure 13:
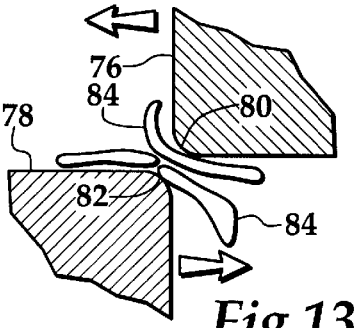
FIG. 13 is a schematic view of the refining action of two dull edge bars.

FIG. 13, on the other hand, illustrates how refiner bars 76 and 78, with dull edges 80, 82, tear paper fibers 84. Although it is desirable to increase the surface area of the individual fibers by the process of fibrillation so that the fibers may bond better with each other, it is not desirable to completely break the fibers. Greater surface area between paper fibers results in greater adhesion between fibers which results in stronger paper. On the other hand, shorter paper fibers means less total surface area per fiber. Shortened fibers bond with fewer other fibers than do long fibers, and the paper formed from the shortened fibers is of reduced strength. In addition, fiber fragments that are rendered too small are not retained on the forming wire of a papermaking machine and are thus lost as sludge. The dull edged refiner bars 76, 78 result in a loss of fiber and an increased cost of manufacturing paper from a given fiber stock, along with the additional detriment of producing a weaker paper.

The refining mechanism of sharp edge bars 70, 72 is not completely understood, but it is thought that the sharp edges staple or hold the fibers in place as the refining action takes place.

In practice it has been found difficult to maintain truly sharp edges as the refiner bars 66, 68 are subject to wear in actual use. A number of techniques for causing the bars to wear sharp have been developed.

Figure 14:
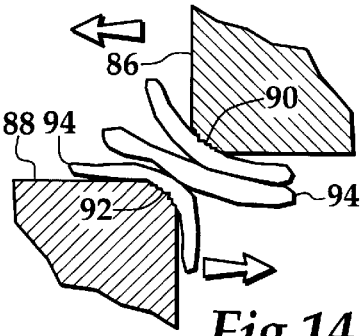
FIG. 14 is a schematic view of the refining action of two rough edge bars.

FIG. 14 illustrates an alternative approach to holding fibers 94 by the employment of rough edges 90, 92 on bars 86, 88. Thus the provision of rough edges on refiner bars can facilitate the fibrillation of wood pulp fibers. In addition, rough edged bars which require a less distinctly sharp edge may be more readily obtained.

Figure 7:
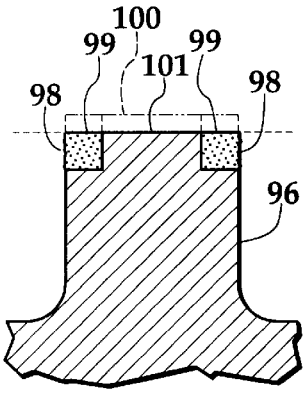
FIG. 7 is a cross-sectional view of a refiner bar with material of a desired characteristic, such as roughness, placed on the outer edges.

FIG. 7 shows a refiner bar 96 in cross-section. The rectangular bar 96 has an upwardly extending central member 101. Small rectangular, corner wedges 98 are formed of an abrasive or other material 99 deposited in edge channel reservoirs extending between the central member 101 and the sides of the bar 96. FIG. 7 shows how once an abrasive material 99 has been emplaced, the upper surface 100 may be ground down to form a leveled surface as required by the close positioning of opposed bars in the refiner plates.

Figure 8:
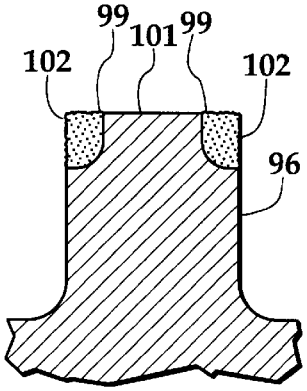
FIG. 8 is a cross-sectional view of an alternative embodiment refiner bar.
Figure 9:
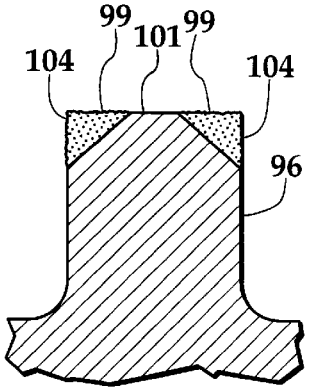
FIG. 9 is a cross-sectional view of another alternative embodiment refiner bar.

FIGS. 8 and 9 show how the refiner bar 96 may have corner wedges 102 and 104 of varying shapes.

Figure 10:
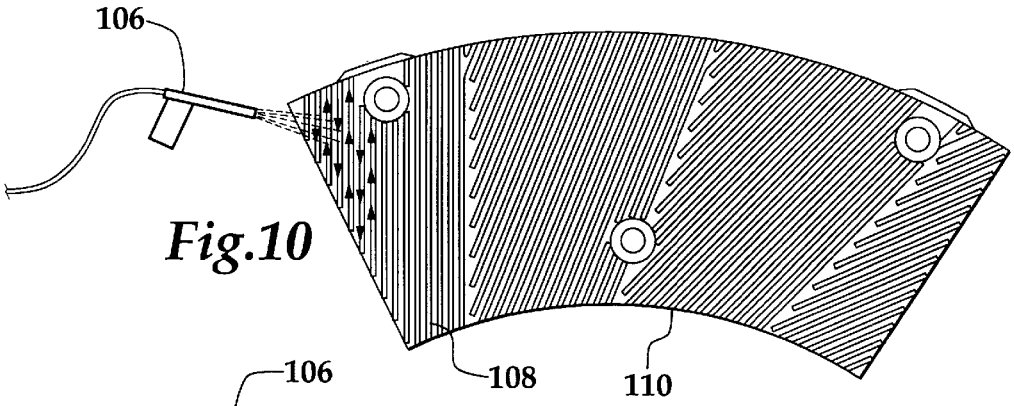
FIG. 10 is a schematic view of the process of coating the edge of the bar of FIG. 7.
Figure 11:
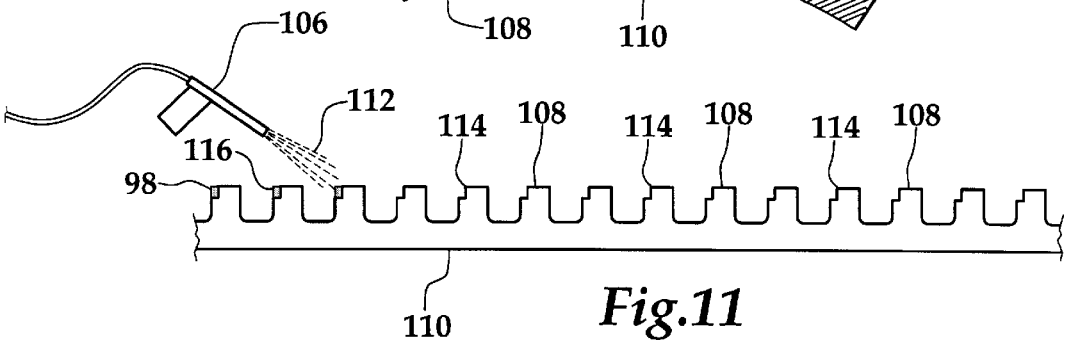
FIG. 11 is a cross-sectional, schematic view of the process of FIG. 10.

FIGS. 10 and 11 show one method of emplacing the abrasive material by the use of a flame spray gun apparatus 106 which is traversed along the bars 108 of a refiner sector 110 which may be used to make up the refiner plates 26, 28. The gun 106 sprays ceramic materials 112 into rectangular grooves 114 to form corner wedges 98. As shown in FIG. 11, the grooves 114 and the corner wedges 98 in some cases will be placed only on the leading edges 116. As shown in FIG. 14, the edges 90, 92 form leading edges of the bars 86, 88. The refining action takes place at the leading edges, and thus the leading edges are most in need of techniques for making them rough.

The corner wedges 98, 102, and 104 may also be formed by the technique as set forth in U.S. Pat. No. 5,492,548 as was discussed for the formation of the abrasive material 16.

Figure 15:
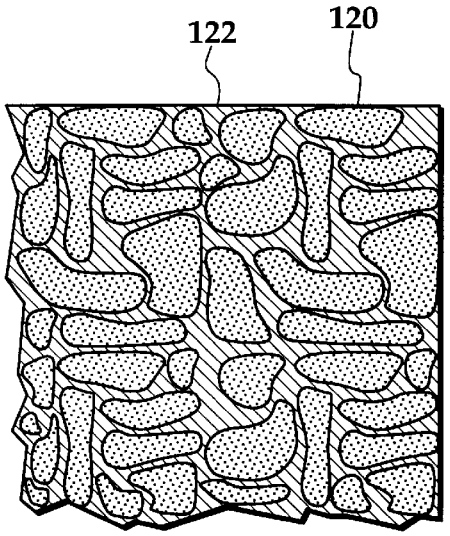
FIG. 15 is a fragmentary, cross-sectional view of a bar formed of white cast iron.
Figure 16:
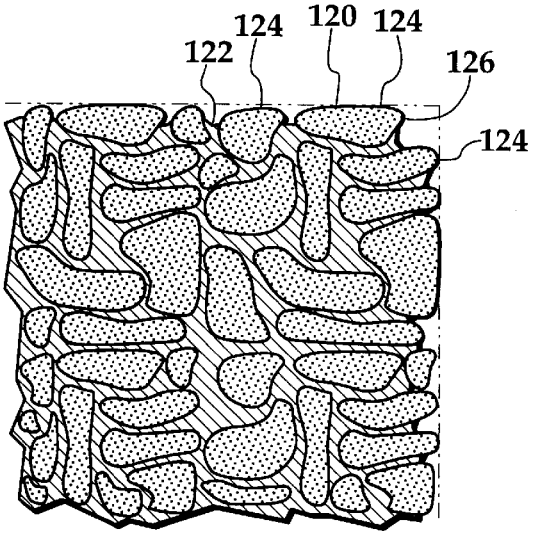
FIG. 16 is a schematic cross-sectional view of the bar of FIG. 15 with the matrix shown etched away.

Another approach to forming selected regions of refiner bars of a rough material is to choose a material which tends to wear rough. Table 1 discloses two cast alloys, chromium white iron and nickel chromium white iron (nihard) which when heat treated develop grains of abrasive carbides 120 in a matrix of softer more malleable material 122 as illustrated in FIGS. 15–19. FIG. 15 shows a material after it has been cast and heat treated. FIG. 16 shows the material after it has been exposed to a sulfuric acid etch or has been allowed to wear. As shown in FIG. 16, the softer matrix 122 has worn away to leave exposed grains 124 which form a rough edge 126.

TABLE 1

| MATERIAL | C | MN | SI | CR | NI | MO |
|---|---|---|---|---|---|---|
| Chromium White Iron | 2.4–4.0 | 0.5–1.0 | 0.5–2.0 | 15–30 | 0.–2.0 | 0.–4.0 |
| Example: 28% Chromium | 2.8 | 0.8 | 1 | 28 | — | 0.5 |
| Nickel Chromium White Iron (Nihard) | 2.5–3.7 | 0.5–1.3 | 0.5–.8 | 1.1–11 | 2.7–7.0 | 0.–.5 |
| Example: Type 1 | 3.3 | 0.6 | 0.8 | 2 | 4.2 | — |

Figure 17:
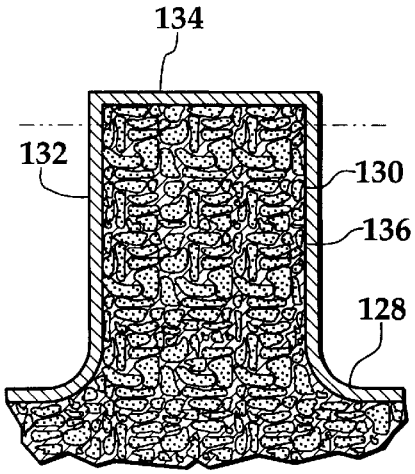
FIG. 17 is a schematic cross-sectional view of the bar of FIG. 15.
Figure 18:
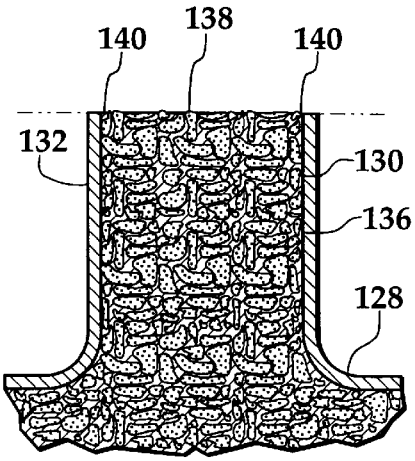
FIG. 18 is a schematic, cross-sectional view of the bar of FIG. 17 after it has been milled away.

Although the materials listed in Table 1 are not new in the application of the formation of refiner discs 26, 28, the materials' tendency to wear rough has proved disadvantageous because the flow channels between the bars have also worn rough and this impedes the flow of stock through the refiner plates because the flow channels tend to clog with fibers. A solution, as illustrated in FIG. 17, is to coat the side surfaces and top surface with a layer of metal or paint or plastic 132,134 which is resistant to abrasive wear, erosion or corrosion. Thus, the flow channel 128 and the sides 136 of the bars 130 are protected from wearing rough or being etched to form rough surfaces. As shown in FIGS. 17 and 18, the upper surface 138 and edges 140 of the bar 130 may be advantageously exposed by grinding the upper surface of the bar to at one time expose it and render it flat and parallel. A grinding operation to render the bars parallel is a normal part of the overall manufacturing process of a refiner plate.

Figure 19:
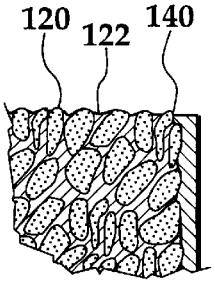
FIG. 19 is an enlarged, fragmentary view of the rough edge of the bar of FIG. 18.

FIG. 19 shows an enlarged fragmentary view of the edge of the bar 130 of FIG. 18 where it can be seen how the edges of the bar tend to wear rough.

It should be understood that although the improved refiner plates have been described as used with a low consistency refiner, the technique disclosed could be used to form refiner plates for use with high consistency refiners.

It should also be understood that where reservoirs are described as filled with an abrasive, the abrasive could be material of other desired characteristics and could be held in place by a number of techniques, including using an adhesive to bond abrasive grit to the grooves or employing solder to bond the abrasive.

It should be understood that the invention is not limited to the particular construction and arrangement of parts herein illustrated and described, but embraces such modified forms thereof as come within the scope of the following claims.

We claim:

1. A plate for a refiner for use in refining a flow of wood fiber stock, the plate comprising:

a base member which extends radially about an axis; and a plurality of refiner bars integrally informed with the base member and extending upwardly from the base member, wherein each bar has two upwardly extending sides and wherein flow channels are defined between spaced bars, and wherein each bar has an uppermost surface, and wherein bar edges are defined where the sides intersect the uppermost surface, and wherein each bar is altered to define portions of the bar which extend to the uppermost surface, said portions being formed of a material having grains of abrasive imbedded therein so that surface portions of the uppermost surface of each bar wear rough, and wherein at least the majority of the two bar sides do not have grains of abrasive imbedded therein and do not wear rough such that the refiner disk has improved refining action without substantial loss in ease of flow of the stock in the flow channels between the bars.

2. The plate of claim 1 wherein the plate is formed of a plurality of sectors which are joined together to form the plate.

3. The plate of claim 1 wherein the refiner bars extend substantially radially along an exterior surface of the base member.

4. The plate of claim 1 wherein the refiner plate base member and bars are integrally cast of white iron which is heat treated to have abrasive grains within a softer matrix, and wherein the flow channels define surfaces, and the cast iron forming the flow channel surfaces has a wear-resistant protective coating joined thereto, so only the uppermost surfaces of the bars wear rough.

5. The plate of claim 4 wherein the wear-resistant protective coating is paint.

6. The plate of claim 4 wherein the wear-resistant protective coating is a polymer.

7. The plate of claim 4 wherein the wear-resistant protective coating is metal.

8. A plate for a refiner for use in refining a flow of wood fiber stock, the plate comprising:

a base member which extends radially about an axis and formed of cast white iron which is heat treated to have abrasive grains within a softer matrix; and a plurality of refiner bars integrally formed of cast white iron which is heat treated to have abrasive grains within a softer matrix with the base member and extending outwardly from the base member, wherein each bar has two sides extending from the base member, the sides and a portion of the base between adjacent bars defining flow channels, and wherein the sides and base portions which define the flow channels have a wear resistant coating joined thereto, such that an uppermost surface extending between the sides of the bar tends to wear rough, while the portions joined to the wear-resistant protective coating resist becoming rougher.

9. The plate of claim 8 wherein the wear-resistant protective coating is paint.

10. The plate of claim 8 wherein the wear-resistant protective coating is a polymer.

11. The plate of claim 8 wherein the wear-resistant protective coating is metal.

12. A plate for a refiner for use in refining a flow of wood fiber stock, the disc comprising:

a base member which extends radially about an axis; and a plurality of refiner bars integrally formed of cast white iron with the base member and extending outwardly from the base member, wherein each bar has two sides which extend upwardly from the base member, and wherein the sides and portions of the base between the bars define flow channels, and wherein each bar has an uppermost surface which adjoins the sides of bar edges, and wherein each bar is altered to define portions forming the bar edges which are comprised of abrasive and binder which are bonded to the bar to form the edges.

13. The plate of claim 12 wherein the portions forming the bar edges are triangular in cross section.

14. The plate of claim 12 wherein the portions forming the bar edges are rectangular in cross section.

15. A plate for a refiner for use in refining a flow of wood fiber stock, the plate comprising:

an annular base member which extends radially about an axis and formed of cast white iron having abrasive grains embedded therein; and a plurality of refiner bars formed of cast white iron having abrasive grains embedded therein and extending outwardly from the base member, wherein each bar has two sides extending from the base member, the sides and a portion of the base between adjacent bars defining flow channels, and wherein the sides and base portions which define the flow channels have a wear resistant coating joined thereto such that an uppermost surface of the bar is not coated with the wear resistant coating to expose the uppermost surface to the wood fiber stock.

16. The plate of claim 15 wherein the plate is comprised of a plurality of segments arranged to form the annular base member.

17. The plate of claim 15 wherein the uppermost surface comprises a surface of the bar that is disposed furthest axially outward from the base member.

18. The plate of claim 15 wherein the abrasive grains are more abrasive than the white cast iron.

19. The plate of claim 15 wherein the abrasive grains are comprised of carbide.

* * * * *